US009963936B2

(12) United States Patent
Kruspe et al.

(10) Patent No.: US 9,963,936 B2
(45) Date of Patent: May 8, 2018

(54) DOWNHOLE CLOSED LOOP DRILLING SYSTEM WITH DEPTH MEASUREMENT

(71) Applicants: Thomas Kruspe, Niedersachsen (DE); Robert A. Estes, Tomball, TX (US); Rocco DiFoggio, Houston, TX (US); Francis Chad Hanak, League City, TX (US)

(72) Inventors: Thomas Kruspe, Niedersachsen (DE); Robert A. Estes, Tomball, TX (US); Rocco DiFoggio, Houston, TX (US); Francis Chad Hanak, League City, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 524 days.

(21) Appl. No.: 14/049,430

(22) Filed: Oct. 9, 2013

(65) Prior Publication Data

US 2015/0096805 A1 Apr. 9, 2015

(51) Int. Cl.

| | |
|---|---|
| ***E21B 47/0224*** | (2012.01) |
| ***E21B 7/04*** | (2006.01) |
| ***E21B 44/00*** | (2006.01) |
| ***E21B 47/09*** | (2012.01) |

(52) U.S. Cl.

CPC ..... *E21B 7/04* (2013.01); *E21B 44/005* (2013.01); *E21B 47/091* (2013.01)

(58) Field of Classification Search

CPC ..... E21B 47/024; E21B 47/04; E21B 47/042; E21B 47/044; E21B 47/06; E21B 47/065; E21B 47/10

See application file for complete search history.

(56) References Cited

U.S. PATENT DOCUMENTS

| | | | |
|---|---|---|---|
| 5,320,180 | A | 6/1994 | Ruley et al. |
| 6,131,694 | A | 10/2000 | Robbins et al. |
| 7,000,710 | B1 | 2/2006 | Umbach |

(Continued)

FOREIGN PATENT DOCUMENTS

WO 2013062525 A1 5/2013

OTHER PUBLICATIONS

PCT International Search Report and Written Opinion; International Application No. PCT/US2014/059306; International Filing Date: Otober 6, 2014; dated Jan. 15, 2015; pp. 1-16.

*Primary Examiner* — Robert E Fuller
*Assistant Examiner* — Steven A MacDonald
(74) *Attorney, Agent, or Firm* — Cantor Colburn LLP

(57) ABSTRACT

A method, system and drilling apparatus for directional drilling are disclosed. A drill bit is located at a downhole end of a drill string in a borehole. A length of the borehole between a surface location and the drill bit at the downhole end of a drill string is determined and an azimuth angle and inclination of the drill bit is obtained. The length of the borehole may be determined by recording an arrival time at a downhole location of an acoustic pulse travelling from a surface location to the downhole location and determines the travel time and borehole length therefrom. A downhole processor determines a position and orientation of the drill bit from the determined length, azimuth angle and inclination and alters a steering parameter of the drill bit using the determined position and orientation of the drill bit to obtain a selected trajectory for drilling the borehole.

13 Claims, 5 Drawing Sheets

(56) References Cited

U.S. PATENT DOCUMENTS

| | | | | |
|---|---|---|---|---|
| 7,114,580 | B1 | 10/2006 | Balogh | |
| 7,283,910 | B2 | 10/2007 | Hassan et al. | |
| 7,318,488 | B2 | 1/2008 | Hutchinson | |
| 7,668,041 | B2 | 2/2010 | Fanini et al. | |
| 7,874,351 | B2 | 1/2011 | Hampton et al. | |
| 8,040,755 | B2 | 10/2011 | Priest | |
| 8,215,384 | B2 | 7/2012 | Trinh | |
| 8,442,769 | B2 | 5/2013 | Phillips et al. | |
| 2008/0105427 | A1 | 5/2008 | Hampton et al. | |
| 2008/0137474 | A1 | 6/2008 | Dashevskiy et al. | |
| 2008/0156484 | A1* | 7/2008 | Mese | E21B 47/10 166/250.1 |
| 2009/0166031 | A1 | 7/2009 | Hernandez | |
| 2010/0089645 | A1* | 4/2010 | Trinh | E21B 10/00 175/50 |
| 2010/0118657 | A1* | 5/2010 | Trinh | E21B 47/011 367/82 |
| 2010/0307742 | A1 | 12/2010 | Phillips | |
| 2011/0098959 | A1 | 4/2011 | Jin | |
| 2012/0018219 | A1 | 1/2012 | Runia | |
| 2012/0097452 | A1 | 4/2012 | Hetz et al. | |
| 2012/0330551 | A1 | 12/2012 | Mitchell et al. | |

* cited by examiner

DOWNHOLE CLOSED LOOP DRILLING SYSTEM WITH DEPTH MEASUREMENT

BACKGROUND INFORMATION

Field of the Disclosure

This disclosure relates generally to directional drilling methods and, in particular, to methods for navigating a formation using a closed loop system using a downhole processor without access to a surface processor.

Brief Description of the Related Art

Boreholes are usually drilled with a drill string that includes a tubular member having a drilling assembly (also referred to as the bottomhole assembly or "BHA") with a drill bit attached to the bottom end thereof. The drill string can be navigated or steered through the formation by changing the orientation of the drill bit while drilling. In general, in order to steer the drill string, various survey measurements may be taken to provide information related to the current location and orientation of the drill bit. These measurements may be obtained using downhole sensors but generally do not provide complete information, such as a position of the drill bit within the formation, required for directional drilling. The measurements are therefore sent a processor that is at a surface location. The surface processor generally has access to this additional information and determines a steering action to be taken at the drill bit. The surface processor then sends a steering signal downhole that may be implemented at the drill bit. As boreholes becomes longer and deeper, time delays and data degradation during communication limits the suitability of this method of drilling.

SUMMARY

In one aspect the present disclosure provides a method of drilling a borehole, including: determining a length of the borehole between a surface location and a drill bit at a downhole end of a drill string in the borehole; obtaining an azimuth angle and inclination of the drill bit; and using a downhole processor to: determine a position and orientation of the drill bit from the determined distance, azimuth angle and inclination, and altering a steering parameter of the drill bit using the determined position and orientation of the drill bit to obtain a selected trajectory for drilling the borehole.

In another aspect, the present disclosure provides a system for drilling a borehole, the system including: a drill string having a drill bit at a downhole end; a downhole clock at the downhole end of the drill string configured to record an arrival time at the downhole end of an acoustic pulse generated in the drill string at a surface location; and a downhole processor configured to: determine a length of the drill string using the recorded arrival time, determine a position and orientation of the drill bit using the determined length and, an obtained azimuth angle and inclination of the drill bit, and alter a steering parameter of the drill bit using the determined position and orientation of the drill bit to obtain a selected trajectory of the borehole.

In yet another aspect, the present invention provides a drilling apparatus that includes: a drill bit at a downhole end of a drill string in a borehole; a receiver at the downhole end of the drill string configured to receive an acoustic pulse generated in the drill string at a surface location; a downhole clock configured to generate a time stamp when the acoustic pulse is received at the downhole receiver; and a downhole processor configured to: determine a length of the drill string using the time stamp, determine a position and orientation of the drill bit using the determined length, a obtained azimuth angle of the drill bit and an obtained inclination of the drill bit, and alter a steering parameter of the drill bit using the determined position and orientation of the drill bit to obtain a selected trajectory.

Examples of certain features of the apparatus disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF THE DISCLOSURE

The present disclosure relates to methods and systems for directional drilling of a borehole. The apparatus may include a downhole processor that determines an orientation and position of a drill bit and/or drilling assembly on a drill string in a borehole and alters a steering parameter of the drill bit to obtain a selected drilling trajectory for the drill string. In an embodiment, the downhole processor performs these actions without any related interaction with a surface processor. The present disclosure is susceptible to embodiments of different forms. The drawings show and the written disclosure describes specific embodiments of the present disclosure with the understanding that the disclosure is to be considered an exemplification of the principles of the disclosed herein, and that it is not intended to limit the disclosure to that illustrated and described herein.

Figure 1:
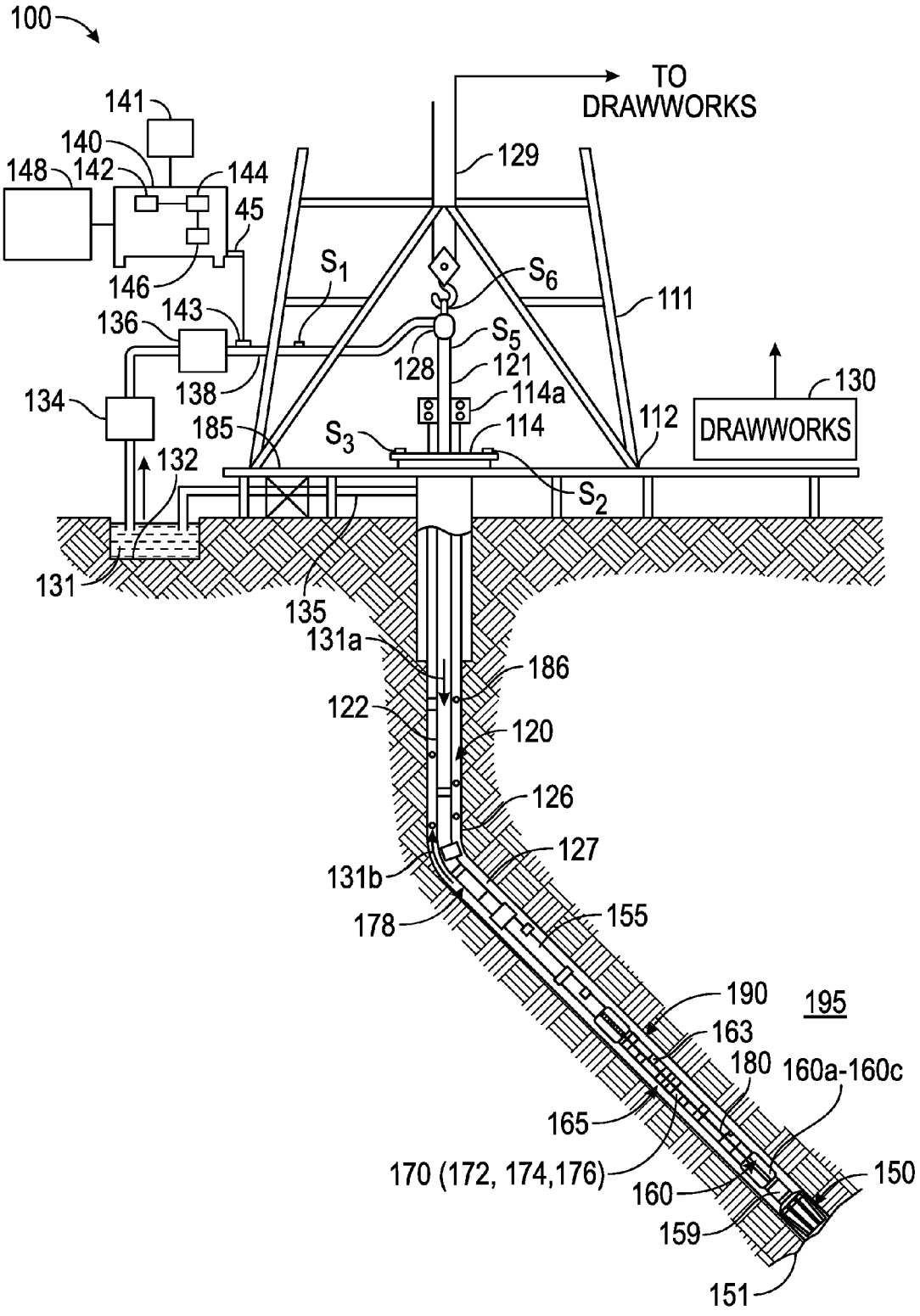
FIG. 1 is a schematic diagram of an exemplary drilling system that includes a drill string having a drilling assembly or a bottomhole assembly attached to its bottom end.

FIG. 1 is a schematic diagram of an exemplary drilling system 100 that includes a drill string 120 having a drilling assembly or a bottomhole assembly 190 attached to its bottom end. Drill string 120 is conveyed in a borehole 126. The drilling system 100 includes a conventional derrick 111 erected on a platform or floor 112 that supports a rotary table 114 that is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to drilling assembly 190, disintegrates the geological formations when it is rotated to drill the borehole 126. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive 114*a* rather than the prime mover and the rotary table 114.

In one aspect, a suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular 122 discharges at the borehole bottom 151 through openings in the drill bit 150. The returning drilling fluid 131*b* circulates uphole through the annular space or annulus 127 between the drill string 120 and the borehole 126 and returns to the mud pit 132 via a return line 135 and a screen 185 that removes the drill cuttings from the returning drilling fluid 131*b*. A sensor $S_1$ in line 138 provides information about the fluid flow rate of the fluid 131. Surface torque sensor $S_2$ and a sensor $S_3$ associated with the drill string 120 provide information about the torque and the rotational speed of the drill string 120. Rate of penetration of the drill string 120 may be determined from sensor $S_5$, while the sensor $S_6$ may provide the hook load of the drill string 120.

In some applications, the drill bit 150 is rotated by rotating the drill pipe 122 using, for instance, the rotary table 114. However, in other applications, a downhole motor 155 (mud motor) disposed in the drilling assembly 190 rotates the drill bit 150 alone or in addition to the drill string rotation.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided by a program to the surface control unit 140. The surface control unit 140 displays desired drilling parameters and other information on a display/monitor 141 that is utilized by an operator to control various drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to various drilling operations, data from the sensors and devices on the surface, data received from downhole sensors and devices and may control one or more operations of such sensors and devices.

The drilling assembly 190 may also contain formation evaluation sensors or devices (also referred to as measurement-while-drilling, "MWD," or logging-while-drilling, "LWD," sensors) for obtaining various properties of interest, such as resistivity, density, porosity, permeability, acoustic properties, nuclear-magnetic resonance properties, corrosive properties of the fluids or the formation, salt or saline content, and other selected properties of the formation 195 surrounding the drilling assembly 190. Such sensors are generally known in the art and for convenience are collectively denoted herein by numeral 165. Such formation evaluation measurements are often indicative of formation lithology, hydrocarbon content, porosity, or other formation parameters that may indicate a presence of a hydrocarbon and which may therefore be used to alter a direction in which a borehole is being drilled. The drilling assembly 190 may further include a variety of other sensors and communication devices 159 for controlling and/or determining one or more functions and properties of the drilling assembly 190 (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. Additionally, the drilling assembly 190 may include one or more survey instruments 163, such as accelerometers, gyroscopes and/or magnetometers, that are configured to provide an inclination of the drilling assembly 190 and/or drill bit 150 and an azimuth or tool face angle of the drilling assembly 190 and/or drill bit 150.

Still referring to FIG. 1, the drill string 120 further includes a power generation device 178 configured to provide electrical power or energy, such as current, to sensors 165, devices 159 and other devices. Power generation device 178 may be located in the drilling assembly 190 or drill string 120. The drilling assembly 190 further includes a steering device 160 that includes steering members (also referred to a force application members) 160*a*, 160*b*, 160*c* that may be configured to independently apply force on the borehole 126 to steer the drill bit 150 along any particular direction.

Additionally, the drill string 120 may include a downhole control unit 170 which may include a downhole processor 172, a memory storage device 174, such as a solid-state memory, tape or hard disc, and one or more computer programs 176 in the storage device 174 that are accessible to the downhole processor 172 for executing instructions contained in such programs to perform the directional drilling methods disclosed herein.

Figure 2:
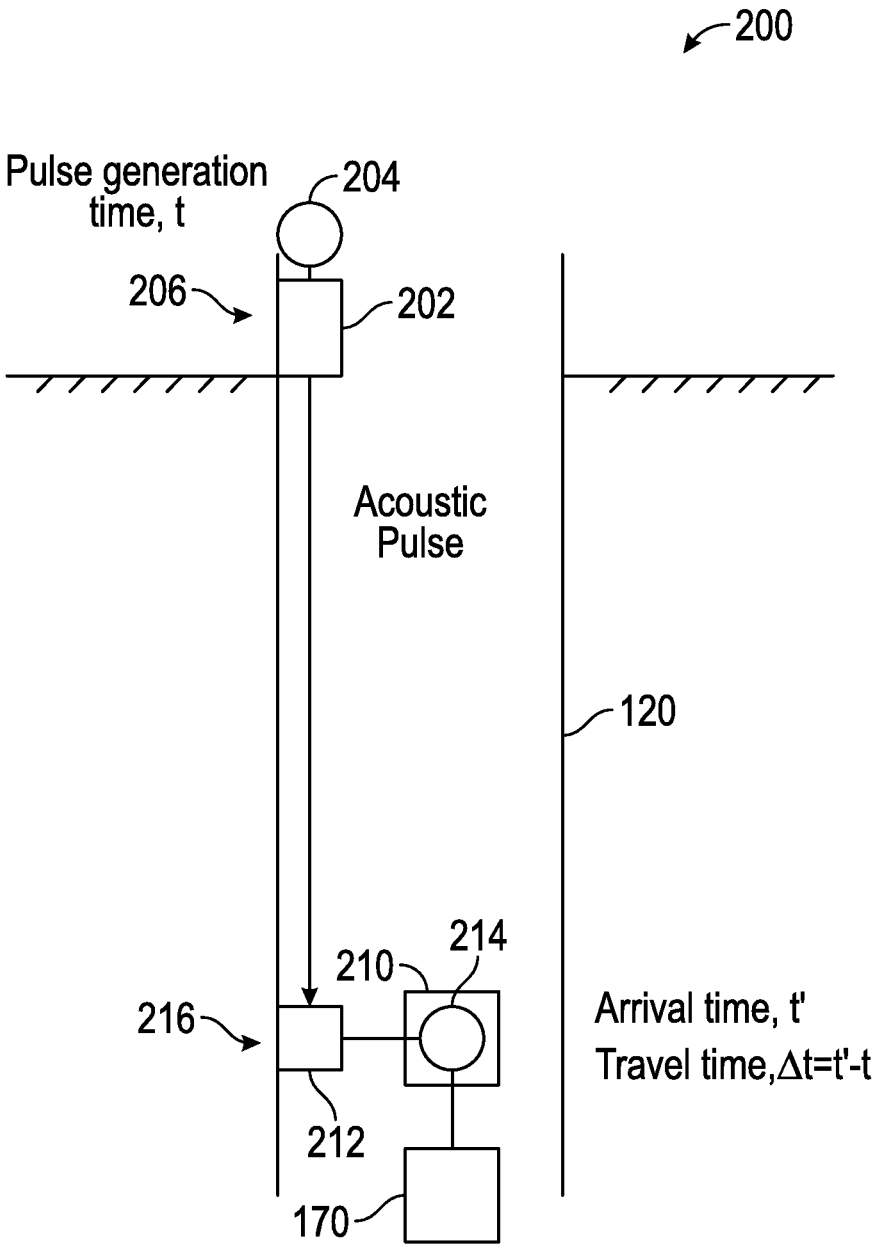
FIG. 2 shows a schematic diagram of the drill string showing various devices for determining a location of a drilling assembly and/or drill bit in a borehole and/or a formation.

FIG. 2 shows a schematic diagram 200 of the drill string 120 showing various devices for determining a location of a drilling assembly and/or drill bit in a borehole and/or a formation. An acoustic generator or acoustic transmitter 202 is disposed at a surface location 206, and an acoustic receiver 212 is disposed at a downhole location 216. The downhole location 216 may be proximate the downhole assembly (190, FIG. 1) or the drill bit (150, FIG. 1) or may be at a known location from the downhole assembly (190, FIG. 1) or the drill bit (190, FIG. 1). The acoustic transmitter 202 is coupled to a first clock 204 (surface clock) and the acoustic receiver 212 is coupled to a second clock 214 (downhole clock). The first clock 204 and the second clock 214 may be synchronized prior to drilling while the second clock 214 is at the surface location 206. The second clock 214 may be contained within a temperature control device 210 that is configured to control the temperature of the second clock 214, thereby reducing or minimizing an amount of temperature-dependent drift as the second clock 214 is conveyed into the elevated temperatures at the downhole location 216. The second clock 214 may be coupled to the downhole control unit 170.

The acoustic transmitter 202 generates an acoustic pulse in the drill string 120 at various times which are periodically spaced from each other. In one embodiment, the acoustic transmitter 202 generates the acoustic pulse by striking an object against the drill string 120. The first clock 204 may provide the time to the acoustic transmitter 202 and the acoustic transmitter 202 may generate the acoustic pulse at a selected time t. Alternately, the first clock 204 may provide a pulse generation signal at the selected time t to trigger the acoustic transmitter 202 to generate the acoustic pulse. The times at which the acoustic pulses are generated may be pre-selected and are generally periodically spaced by a selected time interval.

Thus, the acoustic transmitter 202 generates an acoustic pulse at time t. The acoustic pulse propagates through the drill string 120 and is received by the acoustic receiver 212. The second clock 214 records an arrival time t' of the acoustic pulse at the acoustic receiver 212 and sends the recorded arrival time t' to the downhole control unit 170. The downhole control unit 170 determines a travel time of the acoustic pulse between the acoustic transmitter 202 and the acoustic receiver 212 from the equation:

$$\Delta t = t' - t \qquad \text{Eq. (1)}$$

The travel time Δt may then be used to obtain a distance between the acoustic transmitter 202 and the acoustic receiver 212, thereby obtaining a length of the drill string 120 and/or a length of the borehole 126. In various embodiments, the travel time and a known speed of sound in the drill string is used to determine this distance. Known acoustic properties of the drill string such as the acoustic impedance of the drill string may be used to correct the calculation of the distance between the acoustic transmitter 202 and the acoustic receiver 212. The determined distance may then be used to determine a position of the drill bit 150 within the formation.

Figure 3:
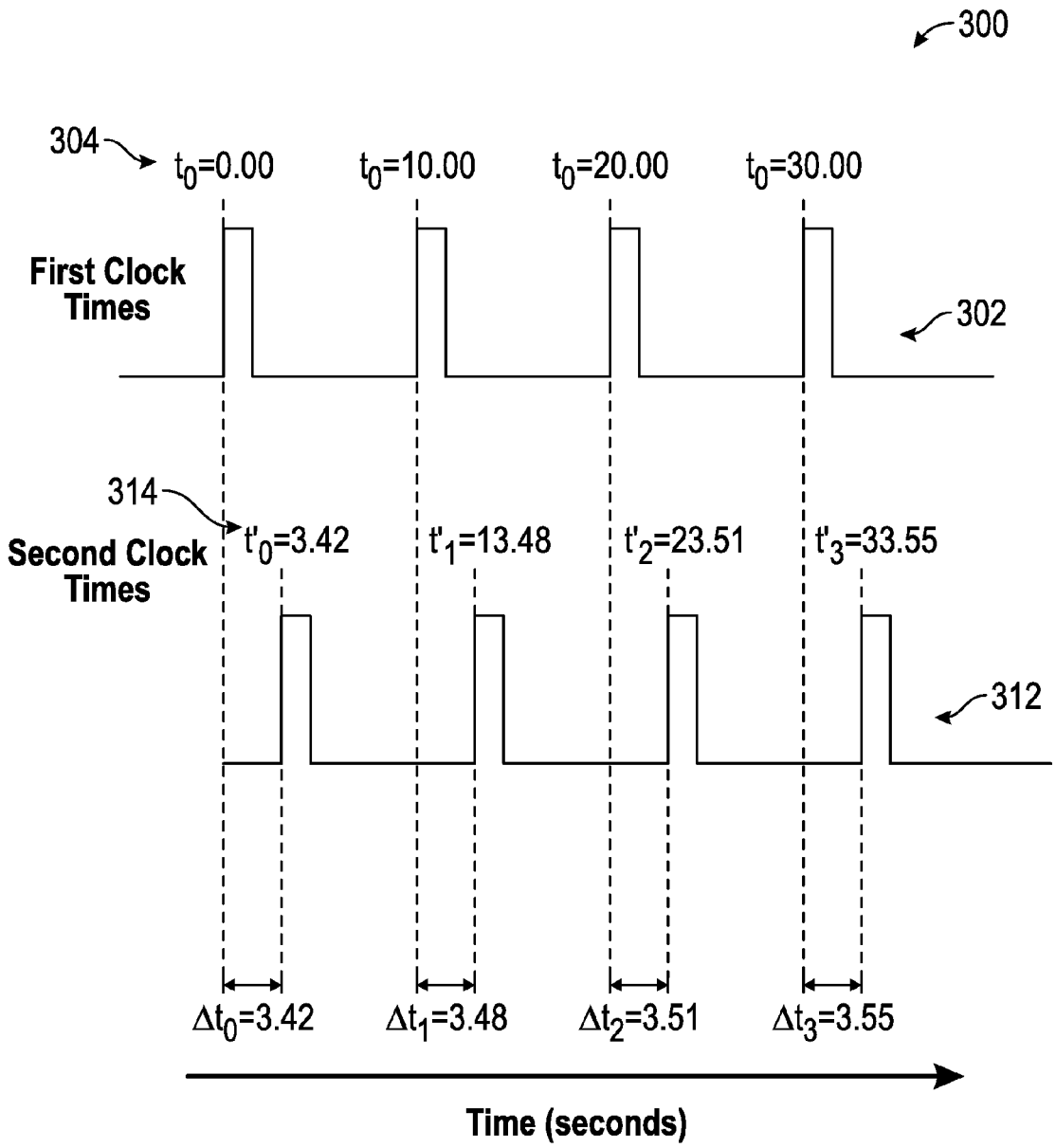
FIG. 3 illustrates generated and received pulse sequences that may be used for determining downhole positions of a drill bit of the drill string.

FIG. 3 illustrates generated and received pulse sequences 300 that may be used for determining downhole positions of the drill bit 150. Acoustic pulses 302 are generated by the acoustic transmitter (202, FIG. 2) at times 304 as indicated using the first clock. In the exemplary illustration, the time interval between pulses is 10 seconds. However, any suitable time interval may be selected. In general, the time interval is long enough so that an acoustic pulse is received at the acoustic receiver 212 within the selected time interval (i.e., before the next pulse in the sequence is generated), and so that acoustic reflections at various reflectors in the drill-string and in the borehole are decayed. The acoustic receiver 212 receives the acoustic pulses and records the arrival times 314 using the second clock 214. In various embodiments, the downhole control unit 170 may calculate the travel time of the acoustic pulse without referring to the times 304 from the first clock 204. Instead, the pulse generation schedule is known at the downhole control unit 170 and is used along with the arrival times 314 to determine travel time.

For example, the first clock may generate illustrative acoustic pulses 302 at every 10 seconds. ($t_0$=0.00 seconds, $t_1$=10.00 seconds, $t_2$=20.00 seconds, $t_3$=30.00 seconds) After propagation through the borehole, the acoustic pulses are received at the illustrative arrival times ($t'_0$=3.42 seconds, $t'_1$=13.48 seconds, $t'_2$=23.51 seconds, $t'_3$=33.55 seconds). The resulting difference between these times (e.g., $\Delta t_0$=3.42 seconds, $\Delta t_1$=3.48 seconds, $\Delta t_2$=3.51 seconds, $\Delta t_3$=3.55 seconds) are used to determine the distance traveled by the acoustic pulse and thus the position of the drill bit 150 within the formation 195. The downhole control unit 170 may receive a selected arrival time, e.g., $t'_1$=13.48 seconds, and knows that the signal was generated by the acoustic transmitter 202 at $t_1$=10 seconds because the pulse generation schedule for the first clock 204 is stored at the downhole control unit 170 and because the first clock 204 and the second clock 214 are synchronized to each other. As shown in FIG. 3, each succeeding travel time Δt is increasing, indicating that the drill bit is travelling into the borehole and away from the acoustic transmitter 202.

Figure 4:
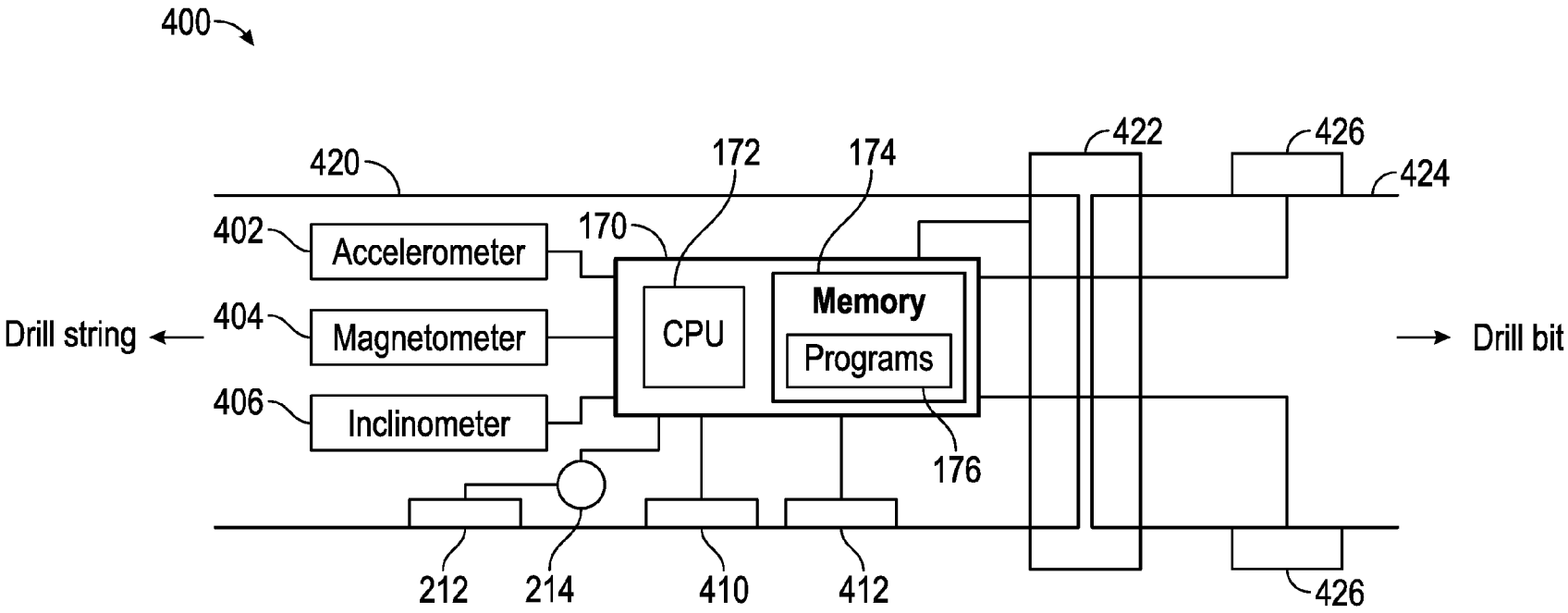
FIG. 4 shows a diagram of section of the drill string including various elements that may be used to control navigation of the drill string using the methods disclosed herein.

FIG. 4 shows a diagram of section 400 of the drill string including various elements that may be used to control navigation of the drill string using the methods disclosed herein. The drill string section 400 may have a drill bit (not shown) attached a lower end and itself may be attached at its upper end to a tubular of the drill string. The drill string section 400 includes the acoustic receiver 212, second clock 214 and downhole control unit 170. The downhole control unit 170 includes downhole processor 172 and a memory storage device 174 that stores one or more computer programs 176 that are accessible to the downhole processor 172 for executing instructions contained in such programs 176. The times for the second clock 214 may be sent to the downhole control unit 170 for determining drill bit position within the formation. Various survey instruments, such as accelerometer 402, magnetometer 404, and inclinometer 406 may provide data to the downhole control unit 170 from which may be determined an orientation of the drill bit, i.e., the inclination and the tool face angle (azimuth).

The drill string section 400 further includes a downhole motor 422 and a steering module 424. The drill bit may be attached to a lower end of the steering module 424. The downhole motor 422 may be used to rotate the steering module 424 and thus the drill bit around an azimuth of the drill string section 400. The downhole control unit 170 may therefore control the rotation of the downhole motor 422 to obtain a selected azimuth or tool face angle of the drill bit. The steering module 424 is equipped with various steering pads 426 which are placed at circumferential location around the steering module 424. Any selected number of steering pads 426 may be used. Each steering pad 426 may be independently extended or retracted from the steering module 424 to exert a force against a wall of the borehole, thereby altering an orientation of the steering module 424 and its attached drill bit. Thus, the downhole control unit 170 may control tool face angle and inclination of the drill bit.

The drill string section 400 further includes various formation evaluation sensors 410, 412 that may provide information to the downhole control unit 170. The downhole processor 172 may perform calculations using the information from the formation evaluation sensors 410, 412 to select a direction for future drilling and steer the drill bit accordingly, as discussed below.

In one embodiment, a selected drill path may be programmed into the downhole control unit 170 at the surface location prior to conveying the downhole control unit into the borehole. The downhole control unit 170 may then use the determined position and orientation of the drill bit 150 at various times during drilling of the borehole and used such determined position and orientation to determine an actual drill path of the drill bit 150. If a difference is observed between the actual drill path and the selected drill path, the downhole control unit 170 may alter an azimuth and/or inclination of the drill bit in order to select a path that reduces or minimizes the difference between the actual drill path and the selected drill path.

Figure 5:
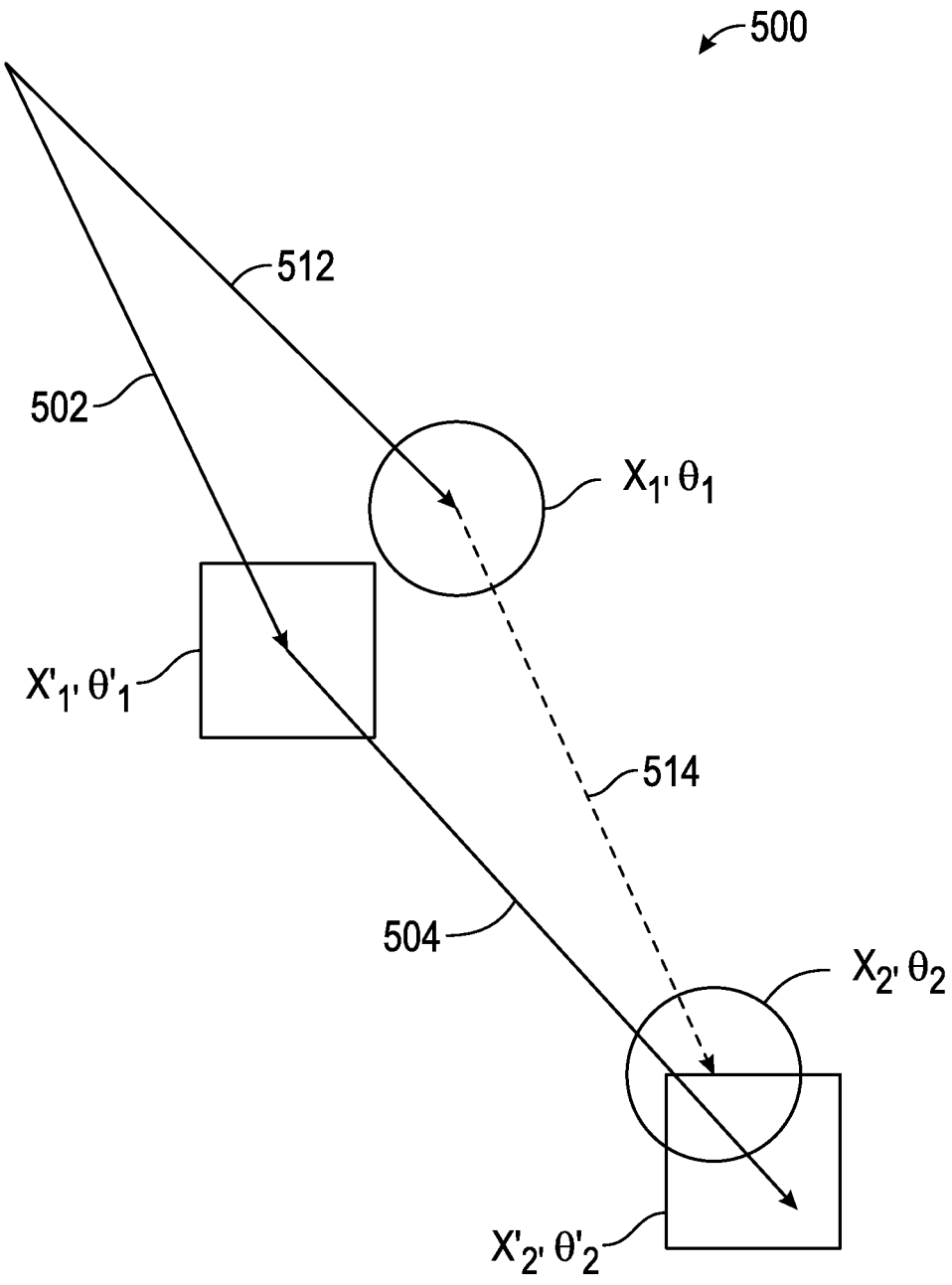
FIG. 5 illustrates an example of path trajectories that may occur during drilling of the borehole using the methods disclosed herein.

FIG. 5 illustrates an example of path trajectories 500 that may occur during drilling of the borehole using the methods disclosed herein. A selected or desired trajectory is divided into several sub-trajectories 502 and 504. It is to be noted that an actual desired trajectory may have hundreds or even thousands of sub-trajectories. Only two such sub-trajectories are shown for illustrative purposes. At the end of sub-trajectory 502, the drill bit is expected to be at location $X_1$ where $X_1$ represents (x, y, z) coordinates and to have an orientation $\Theta_1$ which represents angular coordinates. The expected state of the drill bit 150 may therefore be written as ($X_1$, $\Theta_1$). The state of the drill bit 150 at the end of sub-trajectory 502 is therefore ($X_2$, $\Theta_2$). As the drill bit drills the borehole, it may instead drill along path 512 to find itself in space state ($X'_1$, $\Theta'_1$) at the end of a selected time interval. At this time, the arrival of the acoustic pulse downhole indicates the position coordinates $X'_1$ and the survey measurements are used to obtain $\Theta'_1$. The actual state ($X'_1$, $\Theta'_1$) may therefore be compared to desired state ($X'_1$, $\Theta'_1$) to determine a subsequent drilling path 514. At the end of drilling path 514, the drill bit may find itself at ($X'_2$, $\Theta'_2$) rather than at ($X_2$, $\Theta_2$). Therefore, another calculation may be performed to determine a subsequent drilling path. Since the actual drilling paths 512 and 514 are not collinear, the lengths and orientations of the actual paths 512 and 512 may be used as vectors in order to obtain the position of the drill bit in three-dimensional space. Thus, the actual paths, their locations and orientations may be stored at the downhole memory storage device 174 for use in subsequent position and orientation calculations.

In another embodiment, a model of the formation may be programmed into the downhole control unit 170 prior to conveying the downhole control unit 170 into the borehole. The downhole control unit 170 may then map the determined position and orientation of the drill bit determined using the methods disclosed herein to the formation model. The downhole control unit 170 may then determine a drill bit trajectory for a subsequent drilling path using the mapped position and orientation of the drill bit and the formation model and alter the selected steering parameter (i.e., tool face angle and inclination) accordingly.

In yet another embodiment, the downhole control unit 170 may obtain formation evaluation measurements during drilling, using for example formation evaluation sensors 410 and 412. The downhole control unit 170 may then use the obtained formation evaluation measurements as well as the position and orientation determined using the methods disclosed herein to select a drill bit trajectory for a subsequent drilling path. For example, the drill bit may be drilling horizontally and the formation evaluation measurements may indicate that a hydrocarbon deposit may be found by drilling downward. The drill bit path may then be changed from drilling horizontally to drilling vertically, as determined by the downhole control unit 170.

In various embodiments, the downhole control unit 170 may use any combination of the steering methods disclosed above to steer or navigate the drill bit.

In one aspect of the present disclosure, the downhole control unit 170 is able to steer the drill bit using calculations that are performed entirely downhole. Thus, there is no need to send survey measurements uphole or for an operator at a surface location or an uphole processor to receive such measurements, select a drilling direction and send signals downhole to alter various steering parameters. As a result, the operator is not directly involved with the directional drilling process. Instead, the operator becomes merely an observer and/or administrator of the drilling process. To this end, the downhole control unit 170 may periodically send a progress report uphole for review and/or examination by the operator.

Therefore, in one aspect the present disclosure provides a method of drilling a borehole, including: determining a length of the borehole between a surface location and a drill bit at a downhole end of a drill string in the borehole; obtaining an azimuth angle and inclination of the drill bit; and using a downhole processor to: determine a position and orientation of the drill bit from the determined distance, azimuth angle and inclination, and altering a steering parameter of the drill bit using the determined position and orientation of the drill bit to obtain a selected trajectory for drilling the borehole. The selected trajectory may be: (i) a preselected trajectory stored in a downhole memory location; (ii) a trajectory determined using a formation model stored at the downhole memory location and the determined position and orientation of the drill bit; and/or (iii) a trajectory determined by the downhole processor using in-situ formation measurements obtained downhole. A travel time for an acoustic pulse to traverse the borehole from the surface location to the drill bit is obtained in order to determining the length of the borehole. The acoustic pulse may be generated at the surface location according to a known schedule provided by a first clock. An arrival time of the acoustic pulse is recorded at a downhole acoustic receiver using a second clock at the downhole location. The travel time is then obtained using the recorded arrival time obtained from the second clock and the known schedule for generating the acoustic pulse. The first clock and the second clock are synchronized to each other. In various embodiments, the obtained travel time and a known previous position and orientation of the drill bit are used to determine the position of the drill bit. The acoustic impedance of the drill string may be used correct a calculation of a length of the drill string based on the measured travel time of the acoustic pulse through the drill string. In an exemplary embodiment, the steering parameter of the drill bit is altered using calculations performed entirely at the downhole processor.

In another aspect, the present disclosure provides a system for drilling a borehole, the system including: a drill string having a drill bit at a downhole end; a downhole clock at the downhole end of the drill string configured to record an arrival time at the downhole end of an acoustic pulse generated in the drill string at a surface location; and a downhole processor configured to: determine a length of the drill string using the recorded arrival time, determine a position and orientation of the drill bit using the determined length and, an obtained azimuth angle and inclination of the drill bit, and alter a steering parameter of the drill bit using the determined position and orientation of the drill bit to obtain a selected trajectory of the borehole. The selected trajectory may be at least one of: (i) a preselected trajectory stored in a downhole memory location; (ii) a trajectory determined using a formation model stored at the downhole memory location and the determined position and orientation of the drill bit; and (iii) a trajectory determined by the downhole processor using in-situ formation measurements obtained downhole. The processor may determine the length of the drill string by obtaining a travel time for the generated acoustic pulse to traverse the drill string from a surface location to a downhole location. In one embodiment, an acoustic pulse generator at the surface location generates the acoustic pulse at a scheduled time and the downhole processor obtain the travel time using the recorded arrival time and a known schedule for generating the acoustic pulse. A surface clock may be used for controlling generation of the acoustic pulse at the acoustic pulse generator and the surface clock is synchronized with the downhole clock. The downhole processor may further determine the position of the drill bit using the obtained travel time and a known previous position and previous orientation of the drill bit. The downhole processor may further perform such calculations for altering the steering parameter of the drill bit without communication relevant data to or receiving instructions from an operator or a processor at the surface location.

In yet another aspect, the present invention provides a drilling apparatus that includes: a drill bit at a downhole end of a drill string in a borehole; a receiver at the downhole end of the drill string configured to receive an acoustic pulse generated in the drill string at a surface location; a downhole clock configured to generate a time stamp when the acoustic pulse is received at the downhole receiver; and a downhole processor configured to: determine a length of the drill string using the time stamp, determine a position and orientation of the drill bit using the determined length, a obtained azimuth angle of the drill bit and an obtained inclination of the drill bit, and alter a steering parameter of the drill bit using the determined position and orientation of the drill bit to obtain a selected trajectory. The selected trajectory may be at least one of: (i) a preselected trajectory stored in a downhole memory location; (ii) a trajectory determined using a formation model stored at the downhole memory location and the determined position and orientation of the drill bit; and (iii) a trajectory determined by the downhole processor using in-situ formation measurements obtained downhole. The downhole processor may determine the length of the drill string by obtaining a travel time for the generated acoustic pulse to traverse the drill string from a surface location to a downhole location. In one embodiment, an acoustic pulse generator at the surface location generates the acoustic pulse at a scheduled time and the downhole processor obtains the travel time using the recorded arrival time and a known scheduled time for generating the acoustic pulse. A surface clock synchronized with the downhole clock may be used to control generation of the acoustic pulse at the acoustic pulse generator. The downhole processor may further determine the position of the drill bit using the obtained travel time and a known previous position and previous orientation of the drill bit.

The foregoing description is directed to particular embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

What is claimed is:

1. A system for drilling a borehole, comprising:

a drill string including acoustic reflectors and an acoustic impedance, the drill string having a drill bit at a downhole end;

an acoustic transmitter at a surface location that generates periodically spaced acoustic pulses in the drill string;

a surface location clock for providing a time to the acoustic transmitter to generate the acoustic pulses;

a downhole clock at the downhole end of the drill string configured to record arrival times of the acoustic pulses at the downhole end; and a downhole processor configured to:

calculate travel times of the acoustic pulses using the recorded arrival times and without referring to generation times from the surface location clock, determine a length of the drill string using the calculated travel times, correct the determined length using a known acoustic impedance of the drill string, determine a position and orientation of the drill bit using the corrected length and an obtained azimuth angle and inclination of the drill bit, and alter a steering parameter of the drill bit using the determined position and orientation of the drill bit to obtain a selected trajectory of the borehole, wherein the selected trajectory is determined at the downhole processor using in-situ formation measurements obtained downhole.

2. The system of claim 1, wherein the selected trajectory further comprises at least one of: (i) a preselected trajectory stored in a downhole memory location; and (ii) a trajectory determined using a formation model stored at the downhole memory location and the determined position and orientation of the drill bit.

3. The system of claim 1, wherein the processor is further configured to determine the length of the drill string by obtaining travel times for the generated acoustic pulses to traverse the drill string from the surface location to the downhole end.

4. The system of claim 3, wherein the acoustic transmitter generates the acoustic pulses at a scheduled time and wherein the downhole processor is further configured to obtain the travel times using the recorded arrival times and a known schedule for generating the acoustic pulses.

5. The system of claim 3, wherein the downhole processor is further configured to determine the position of the drill bit using the obtained travel time and a known previous position and previous orientation of the drill bit.

6. The system of claim 1, wherein a surface clock used for controlling generation of the acoustic pulse at the acoustic transmitter is synchronized with the downhole clock.

7. The system of claim 1, wherein the downhole processor is further configured to perform calculations for altering the steering parameter of the drill bit without receiving instructions from an operator or a processor at the surface location.

8. A drilling apparatus, comprising:

a drill string including acoustic reflectors and an acoustic impedance in a borehole;

a drill bit at a downhole end of the drill string;

an acoustic transmitter at a surface location that generates periodically spaced acoustic pulses in the drill string;

a surface location clock for providing a time to the acoustic transmitter to generate the acoustic pulses;

a receiver at the downhole end of the drill string configured to receive the acoustic pulses;

a downhole clock configured to generate time stamps when the acoustic pulses are received at the downhole receiver; and a downhole processor configured to:

calculate travel times of the acoustic pulses using the time stamps and without referring to generation times of the acoustic pulses from the surface location clock, determine a length of the drill string using the calculated travel times, correct the determined length using a known acoustic impedance of the drill string, determine a position and orientation of the drill bit using the corrected length, a obtained azimuth angle of the drill bit and an obtained inclination of the drill bit, and alter a steering parameter of the drill bit using the determined position and orientation of the drill bit to obtain a selected trajectory, wherein the selected trajectory is determined at the downhole processor using in-situ formation measurements obtained downhole.

9. The drilling apparatus of claim 8, wherein the selected trajectory further comprises at least one of: (i) a preselected trajectory stored in a downhole memory location; and (ii) a trajectory determined using a formation model stored at the downhole memory location and the determined position and orientation of the drill bit.

10. The drilling apparatus of claim 8, wherein the downhole processor is further configured to determine the length of the drill string by obtaining travel times for the generated acoustic pulses to traverse the drill string from the surface location to the downhole end.

11. The drilling apparatus of claim 8, wherein the acoustic transmitter generates the acoustic pulses at a scheduled time and the downhole processor is further configured to obtain the travel times using the recorded arrival times and a known scheduled time for generating the acoustic pulses.

12. The drilling apparatus of claim 11, wherein a surface clock synchronized with the downhole clock is used to control generation of the acoustic pulse at the acoustic transmitter.

13. The drilling apparatus of claim 8, wherein the downhole processor is further configured to determine the position of the drill bit using the obtained travel time and a known previous position and previous orientation of the drill bit.

* * * * *